US006193592B1

(12) United States Patent
Grupe

(10) Patent No.: US 6,193,592 B1
(45) Date of Patent: Feb. 27, 2001

(54) INTEGRATED DOUBLE SEAM GRINDER FOR MANUAL WELDING PREPARATION

(75) Inventor: Horst Grupe, Bad Rappnau (DE)

(73) Assignee: MV Marketing und Vertribes-GmbH & Co. KG Wielander + Schill (DE)

( * ) Notice: Subject to any disclaimer, the term of this patent is extended or adjusted under 35 U.S.C. 154(b) by 0 days.

(21) Appl. No.: 09/149,893

(22) Filed: Sep. 8, 1998

(30) Foreign Application Priority Data

Sep. 8, 1997 (DE) ..... 297 16 114 U

(51) Int. Cl.[7] ..... B24B 23/00
(52) U.S. Cl. ..... 451/344; 451/358; 451/194
(58) Field of Search ..... 451/194, 132, 451/344, 358, 456, 545, 558

(56) References Cited

U.S. PATENT DOCUMENTS

| | | | | |
|---|---|---|---|---|
| 721,935 | * | 3/1903 | Buncke | 451/109 |
| 798,011 | * | 8/1905 | Christie | 451/194 |
| 1,006,881 | * | 10/1911 | Russell | 451/132 |
| 2,362,699 | * | 11/1944 | Kilian | 451/132 |
| 2,578,149 | * | 12/1951 | Pocci | 451/358 |
| 2,805,529 | * | 9/1957 | Mathes | 451/194 |
| 3,258,878 | * | 7/1966 | Clark | 451/194 |
| 3,468,076 | * | 9/1969 | Jones | 451/456 |
| 3,621,505 | * | 11/1971 | Vocker et al. | 15/23 |
| 4,016,684 | * | 4/1977 | Urda | 451/344 |
| 4,368,598 | * | 1/1983 | Kuhlmann | 451/344 |
| 4,528,777 | * | 7/1985 | Bernstein et al. | 451/132 |
| 4,683,682 | * | 8/1987 | Pennison | 451/295 |
| 4,735,020 | * | 4/1988 | Schulz et al. | 451/344 |
| 4,788,797 | * | 12/1988 | Kane et al. | 451/344 |
| 5,016,398 | * | 5/1991 | Fukunaga et al. | 451/194 |
| 5,299,394 | * | 4/1994 | Surdacki | 451/50 |
| 5,390,445 | * | 2/1995 | Glovanazzi et al. | 451/194 |

FOREIGN PATENT DOCUMENTS

| | | | | |
|---|---|---|---|---|
| 82 06 388 | * | 6/1982 | (DE) . | |
| 82 06 338 U 1 | | 6/1982 | (DE) | B24B/29/00 |

* cited by examiner

*Primary Examiner*—Lee Young
*Assistant Examiner*—Sean Smith

(57) ABSTRACT

A hand-held, material removing tool for processing sheet material, having a first abrasive body having on the outer surface thereof a material-remover for processing of sheet material, a drive device for driving the abrasive body, and a second abrasive body driven by the drive device, such that a double-sided simultaneous processing by both abrasive bodies of the sheet material arranged between the abrasive bodies is enabled.

15 Claims, 7 Drawing Sheets

INTEGRATED DOUBLE SEAM GRINDER FOR MANUAL WELDING PREPARATION

BACKGROUND OF THE INVENTION

1. Field of the Invention

The invention relates to a hand-held material-removing tool in general, and more particularly, to a grinding tool for working sheet material.

In recent years, spot welding has been increasingly used in the field of special body repair, because of the pressure on the automobile producers. Advantages provided by spot welding are in particular that a repair can be carried out according to the standards of the respective automobile producer, and this corresponds exactly to the production process of the vehicle. Particular advantages thereby accrue, that e.g. crash behavior of a vehicle corresponds to the original vehicle, even when the vehicle is extensively provided with new material in elements which are load bearing and those which are not.

Furthermore, the problem arises when the new kinds of high strength steel are used that the conventional protective gas welding process lead to embrittlement because of their high heat content, and can thus limit the strength of the whole vehicle structure.

Furthermore, insuring rust protection after the repair can only be guaranteed by using the spot welding process.

However, a prerequisite for satisfactory spot welding it that all surfaces are metallically bare before the welding process.

2. Description of Relevant Art

The grinding process preceding welding is up to now carried out in the workshops with the tools available there. Angle grinders, belt grinders, wire brushes or similar appliances, which remove the primer and paint in the region of the zone of apposition, are in particular used for this purpose. The process of exposing the sheet metal is however very uneven when working freehand, and therefore it cannot be insured that the existing material thickness is maintained, and the material cannot be prevented from being impermissibly weakened by excessive grinding. Furthermore, sparks which arise, particularly in angle grinding, present a danger to the operator.

Since the work appliances mentioned hereinabove were not originally provided for sheet metal grinding, the ease of handling them can also be expected to give rise to problems when material is to be ground away in small corners or angles. The desired uniform exposing of the sheet metal regions to be welded can then only be attained, if at all, by the use of several tools.

SUMMARY OF THE INVENTION

The invention consequently has as its object to avoid the abovementioned disadvantages. A further object of the invention is to provide a material removing tool which is ergonomic to operate, light and easy to handle, and which insures a constant grinding quality in the whole weld region.

This object is attained in a very surprising manner by a hand-held, material removing tool for processing sheet material, with at least a first abrasive body having on the outer surface thereof a material-remover for processing of sheet material, a drive device for driving the abrasive body, and a second abrasive body driven by the drive device, such that a double-sided simultaneous processing by both abrasive bodies of the sheet material arranged between the abrasive bodies is enabled.

A grinding appliance which can be handled in a simple manner, and which makes possible a simultaneous two-sided sheet metal processing, can be provided by the use of two abrasive wheels which can be driven by the drive device. Not only does a time advantage of at least 50% as against all known hand-held tools result, but also a metal sheet to be welded can as a rule be finish processed in a single machining process.

In a particularly advantageous manner, the metal sheet to be machined can be securely grasped on both sides by the abrasive wheels, when a respective one of two drive shafts each holding a respective abrasive wheel is arranged to be pivotable toward the other. By this means, the metal sheet to be processed can be gripped as if by tongs by the tool according to the invention, and a substantially equal pressing force is provided on both sides of the metal sheet. In a further advantageous embodiment, one or both of the drive spindles can be constructed as swing axles, thereby decoupling the abrasive wheels from pivoting motions of the operator.

The quality of grinding is greatly improved and kept very constant by means of a control device by which the contact pressure of the drive spindles on the abrasive wheels can be limited or automatically set, independently of the operating pressure of an operator. An always very high quality grinding result can be insured, nearly independently of the actuation by the operator, by the pre-defined contact pressure of the drive spindles, in correspondence with predetermined rpm and/or torque values.

Simple sweeping with the tool according to the invention over the place on the metal sheet which is later to be welded is sufficient to obtain, in a single working process, a precisely defined exposed sheet surface on both sides of a metal sheet to be processed.

Although the invention could in principle also be carried out with abrasive wheels which swing back and forth, the most preferred embodiment includes a drive device with a rotary drive. Furthermore, the abrasive wheels are rotationally symmetrical abrasive wheels, such as are described in the German Utility Model of MV Marketing und Vertriebs-GmbH & Co. KG Wieländer+Schill with the title "Tool for Material-Removing Processing," with the same filing date as the priority application for the present invention which Utility Model is incorporated herein by reference. This abrasive wheel is substantially characterized by an outer jacket which is automatically aligned parallel to the surface to be processed. With an abrasive wheel of this kind, the tool according to the invention can have a pendular axle and a rigid axle for driving the abrasive wheels. A reliable grinding result is always achieved over the whole width of the abrasive wheel, even when a tilting of the tool occurs.

If the hand-held material-removing grinding tool has at least one axial stop that forms a guide device for the abrasive wheel relative to the edge of the metal sheet to be processed, preferably together with a suitable choice of the width of the abrasive wheel, precisely defined regions of the sheet surfaces to be exposed can thereby be predetermined in a very simple manner. The operator only has to pull the tool according to the invention along, with the axial stop on the metal sheet, and thereby achieves exposed sheet regions which very exactly correspond to the weld points predetermined by the respective automobile producer.

If the drive shaft of the abrasive wheel, or the abrasive wheel itself, is removably attached to the tool, a rapid change of used abrasive wheels is thereby made possible. If, however, one of the two abrasive wheels is removed together with its associated drive shaft, the tool according to the invention can be used for single-sided processing, such as at places of a vehicle body which are accessible from only one side, or with difficulty. A universal tool is thereby provided which can process nearly all seams on body parts, and avoids the recourse to additional tools.

A further lightening of the work of the operator results from an actuating element which is arranged laterally on the tool according to the invention and which can be operated with one hand and makes all the operating processes possible with one handle.

In a particularly advantageous manner, the actuating element can be secured against switching on when in the switched-off basic position, the abrasive wheels can be pivoted toward each other in the position with the safety device released, and the drive motor can be switched on before or during the pivoting of the abrasive wheels. In a preferred manner, the release of the safety device can take place by a simple longitudinal displacement of the actuating element, and the pivoting of the abrasive wheels can be effected by pressing this element in.

In an embodiment which is suitable for use in a professional workshop, the drive motor is a pneumatic motor and its shutoff valve has an integrated, adjustable throttle.

In an alternative embodiment according to the invention, the drive motor is an electric motor which is driven from the supply current or from batteries, and whose torque and/or rpm is electronically regulated.

The operator can always be protected from the rotating abrasive wheels and from fine dust, both in double-sided grinding and also in single-sided grinding, by means of a covering which can be set reversibly on the housing of the tool and respectively provides two covering regions. The protection from dust is further improved by a suction device for abrasion material, arranged on the housing or on the covering of the tool.

BRIEF DESCRIPTION OF THE DRAWINGS

The invention is described in detail hereinbelow with reference to the accompanying drawings, in which.

DETAILED DESCRIPTION OF PREFERRED EMBODIMENTS

In the following detailed description of the invention, the concept "sheet metal" is to include any known sheet material for bodies. Consequently, steel, aluminum, or optionally even other metallic materials or plastics are included under sheet metal.

Furthermore, in the sense according to the invention, the concept of "grinding" is to include all processes which lead to removal of material from metal sheets and which remove coverings or coatings, and also other materials such as, for example, lacquers, contamination, corrosion or the like, by mechanical removal.

Figure 1:
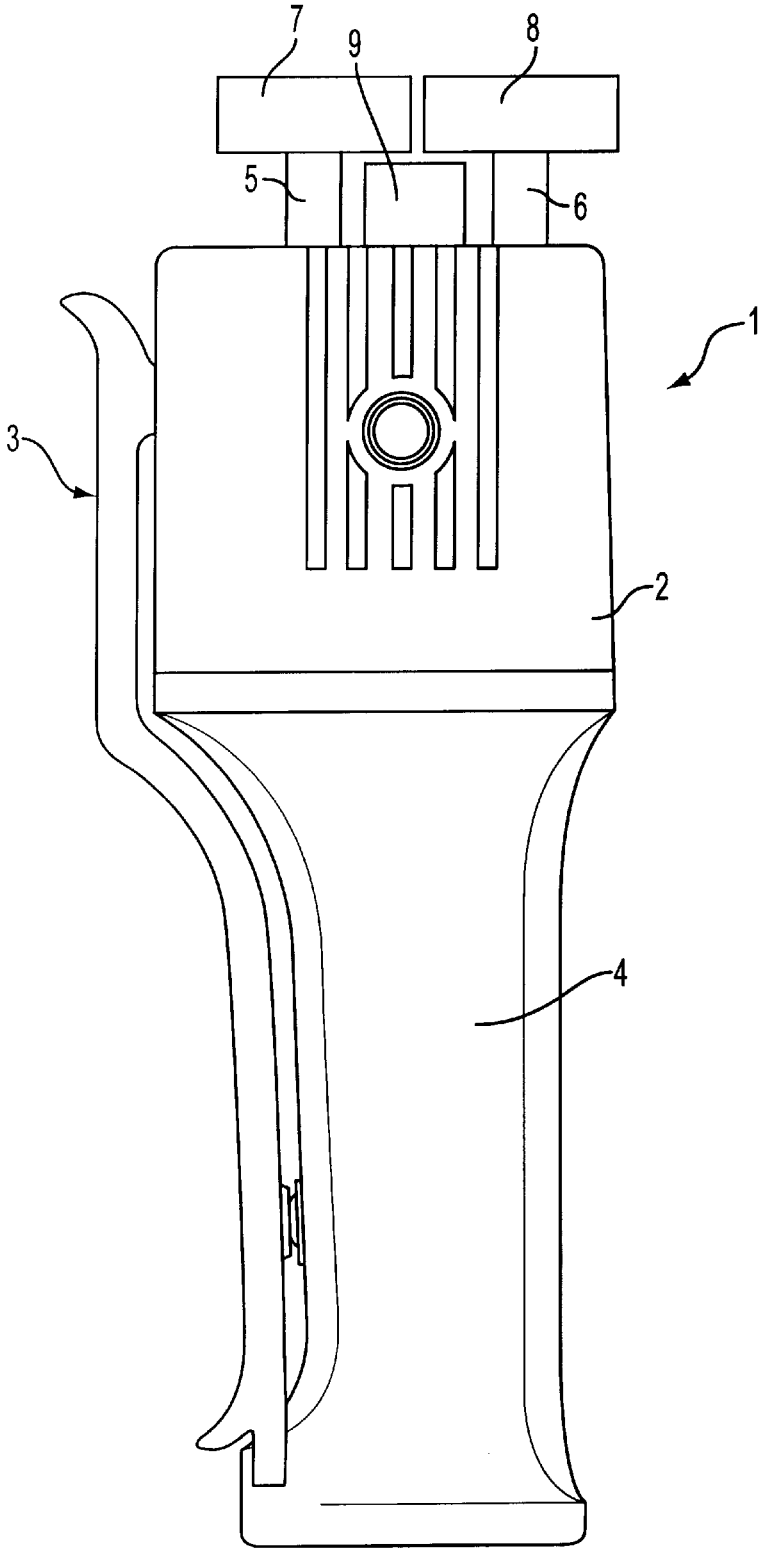
FIG. 1 shows a view of a tool according to a first embodiment of the invention.

Reference is made to FIG. 1, which shows a view of a hand-held material-removing tool 1 according to a first embodiment of the invention.

The tool 1 includes a two-part housing 2, on the left side of which an actuating element 3 is held, and can be displaced in its longitudinal direction and can be pressed into the housing 2 at its upper end.

The housing integrally forms in its lower section a handle shell 4 for grasping the tool 1, such that while the tool is held in one hand, the actuating element 3 can be pushed upward relative to the housing 2, and at its upper portion 15 can be pressed into the housing 2.

Two drive shafts 5, 6 project from the housing 2 at its upper side, with the rotationally symmetrical abrasive wheels 7, 8 held on their ends and secured against torsion.

An axial stops 9, or alternatively two axial stops 9, 10, are formed between the drive shafts, which form in the axial direction of the drive shafts 5, 6 a limitation and guide for metal sheets 11 pushed between the abrasive wheels 7, 8. A side view of the axial stops 9, 10 can be seen in FIG. 3.

The axial stops 9, 10 can either be mounted permanently fixed or, in a further embodiment according to the invention, displaceable in the axial direction of the drive shafts 5, 6. A defined spacing can thereby be set between the edge of a metal sheet to be processed and the surface which is to be processed by the abrasive wheels 7, 8.

A conventional means for removal of material, such as for example corundum or sand with a suitable particle size, is attached to the outer side of the abrasive wheels 7, 8 and is suited to the coating to be removed from the sheet metal, as is well known to one skilled in this art.

Preferred widths of the abrasive wheels 7, 8 amount to about one to three centimeters, the abrasive wheels themselves being able to align themselves parallel to a metal sheet 11 which is inserted tilted between them. Such abrasive wheels are described in the initially mentioned parallel Utility Model of MV Marketing und Vertriebs-GmbH & Co. KG Wieländer+Schill.

Figure 2:
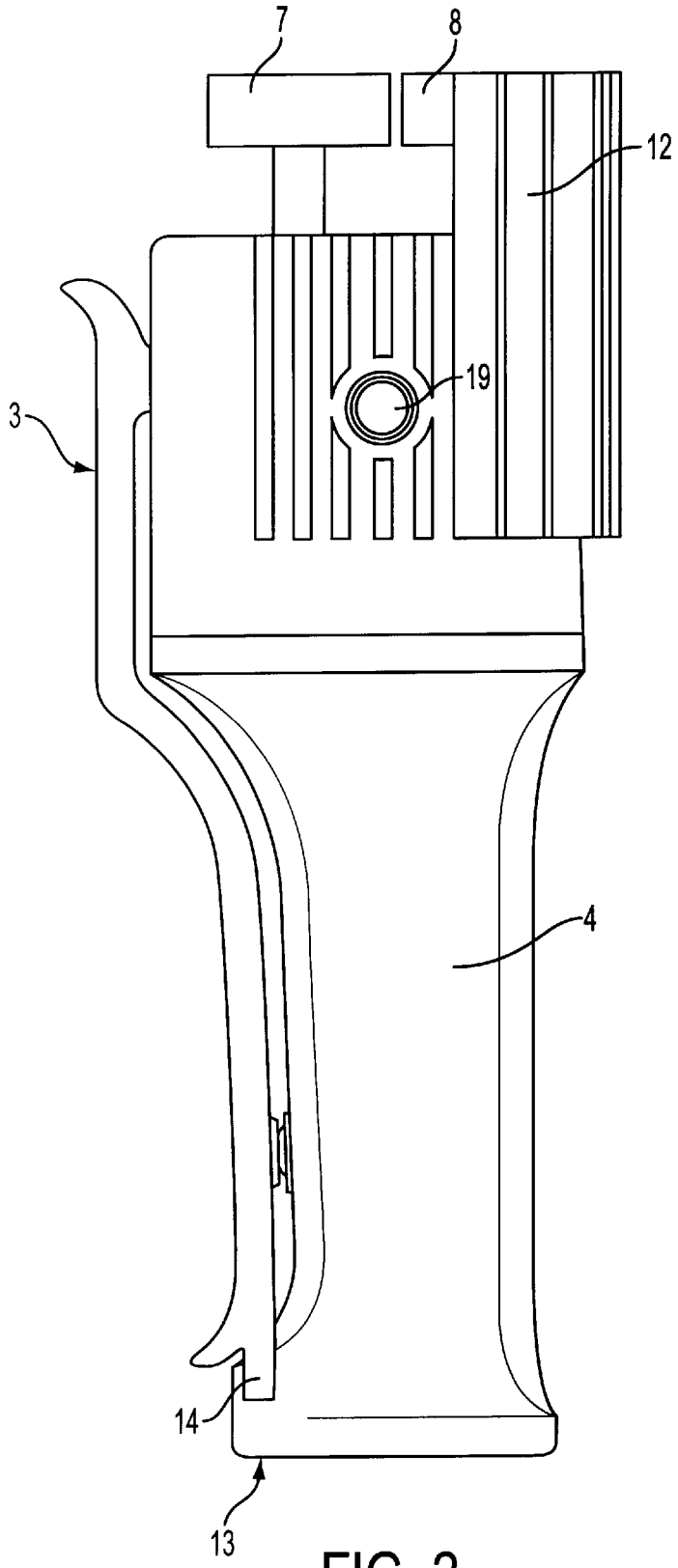
FIG. 2 shows a view of the tool shown in FIG. 1, with a cover attached to it, but without an axial stop.

The housing 2 can furthermore be provided, as shown in FIG. 2, with a cover 12 substantially having a U-shape in cross section and surrounding the drive shaft 6 and the abrasive wheel 8 substantially concentrically, as a half shell.

The cover 12 can be connected to suction devices (not shown in the drawing), for example a dust extraction device, in order to carry away, in a manner not harmful to the operator, the abrasion material resulting from the processing.

Because of its symmetry, the cover 12 can furthermore also be pushed onto the housing on the left-hand side, opposite to that in FIG. 2, and thus form a protection against dust when the abrasive wheel 8 is used by itself, that is, only the right-hand side of the tool is used for sheet processing. To attach two covers 12, on both sides, is also within the scope of the invention.

Furthermore, it is within the scope of the invention to alternatively connect the housing 2 to a dust extraction device.

Figure 4:
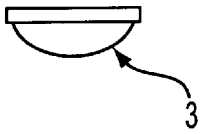
FIG. 4 shows a cross section through the actuating element of the tool according to the invention.
Figure 5:
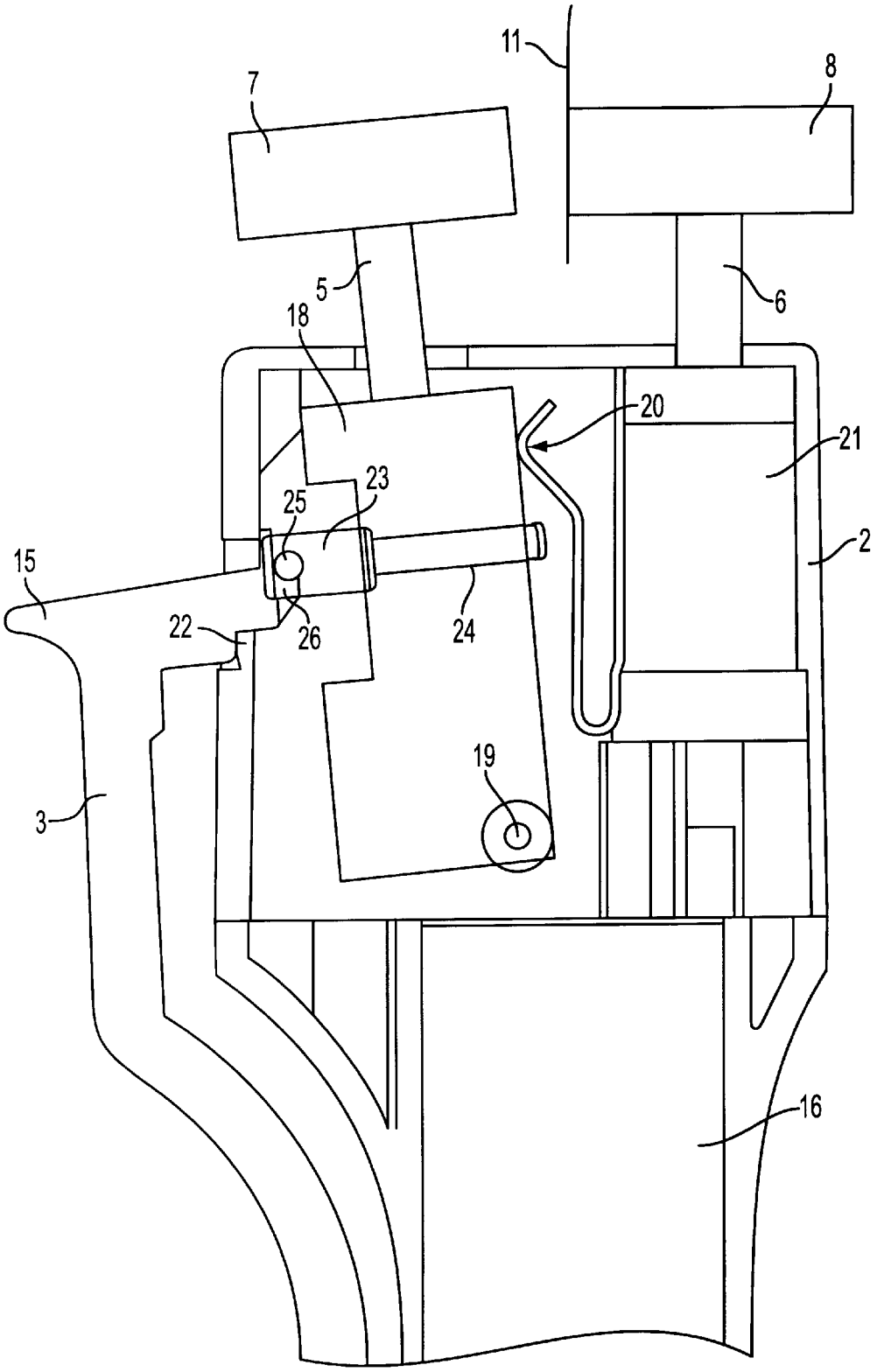
FIG. 5 shows a diagram of a cross section through the upper portion of the tool according to the invention shown in FIG. 1, in which the actuating element is in its secured basic position.

Reference will now be made to FIG. 5, which shows a diagram of a cross section through the upper portion of the housing 2, the actuating element 3 shown in cross section in FIG. 4 being arranged in its secured position.

Figure 3:
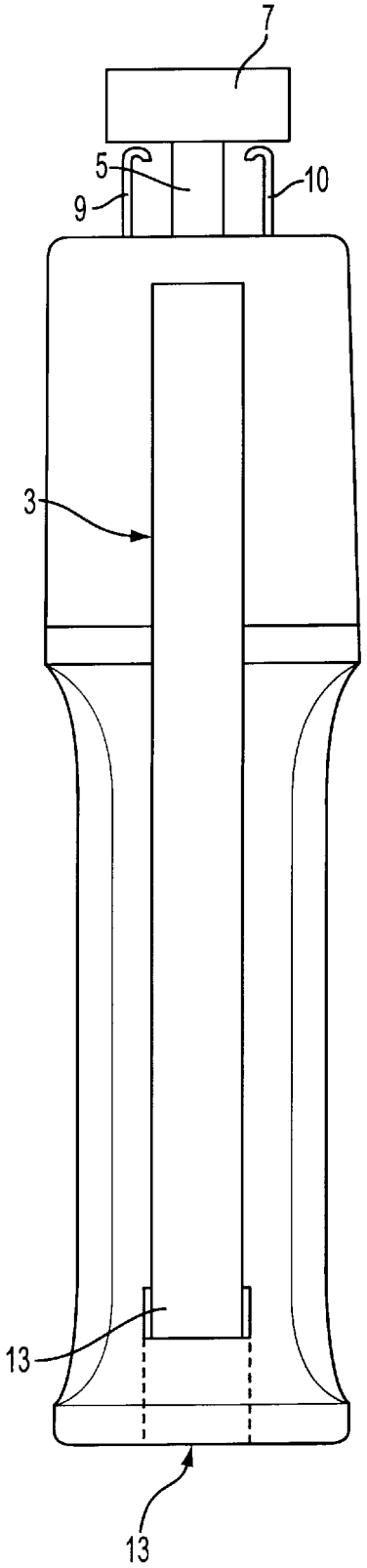
FIG. 3 shows a view, turned through 900, of the tool shown in FIG. 1, with two axial stops.
Figure 8:
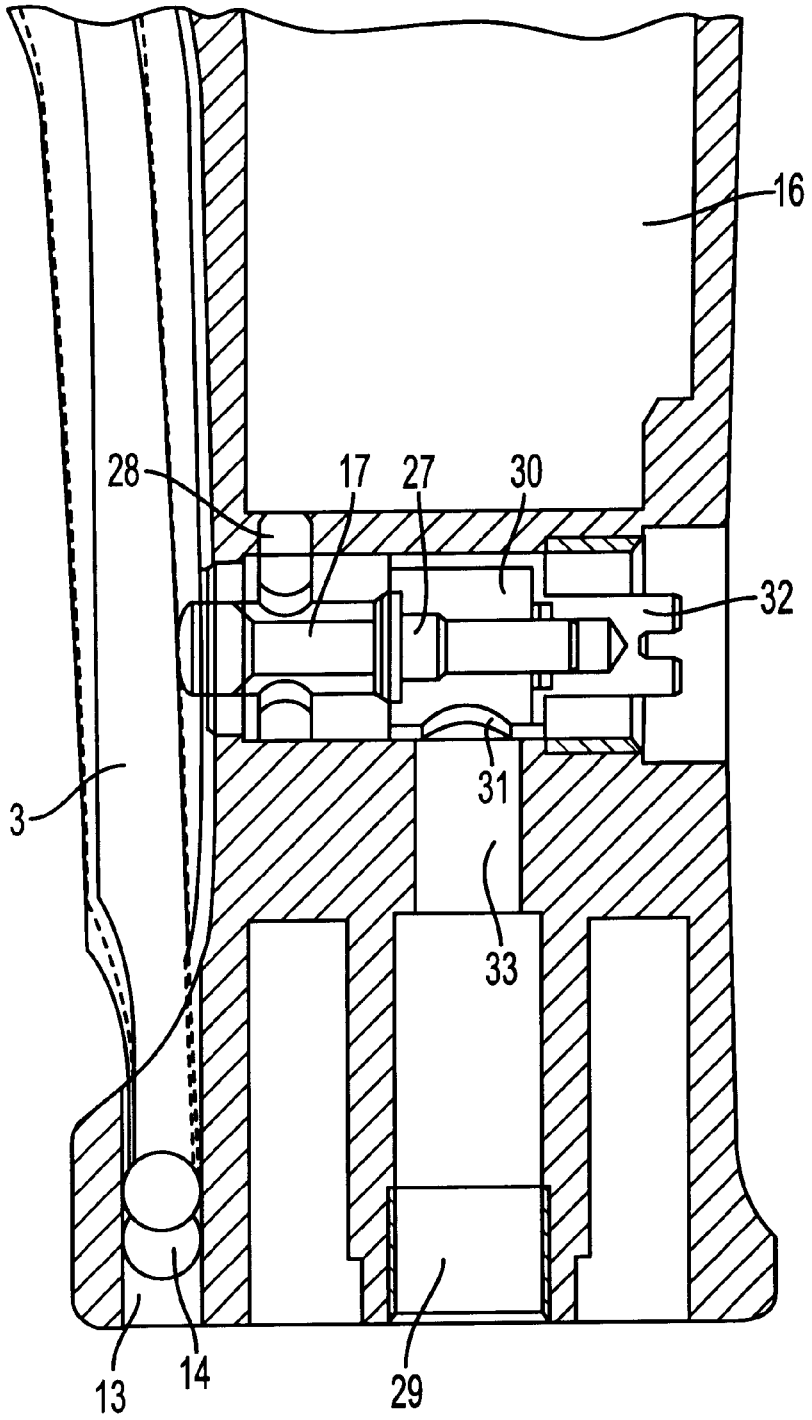
FIG. 8 shows a cross sectional diagram which runs through the lower portion of the tool according to the invention.

The actuating element 3 is longitudinally displaceable in a channel 13 of the housing 2 with a rectangular cross section, and is pivotably held at its lower, cylindrically shaped end 14 (see also FIGS. 2, 3 and 8).

The upper end 15 of the actuating element 3, in its secured position in which it is pushed downward, strikes against a projection 22 of the upper portion of the housing 2, and cannot be pushed into the housing in this position. Inadvertent starting of the drive motor 16 due to an actuation of the starting switch or starting valve 17 can be prevented in this manner. In the switched-off state of the tool 1 shown in FIG. 5, the shaft 5 held in a drive spindle 18 is pivoted toward the left by the force of the leaf spring 20, away from the drive shaft 6 and also from the metal sheet 11 to be processed. The drive spindle 21 is rigidly arranged in the housing 2, substantially parallel to its longitudinal axis and parallel to the longitudinal axis of the motor 16.

The drive spindles 18, 21 can have one or more ball bearings or slide bearings for the drive shafts 5, 6, and connect the drive shafts 5,6 to the drive motor 16 such that a contra-rotating motion of the abrasive wheel 7 relative to the abrasive wheel 8 is produced at the place of grinding. This means that when the abrasive wheel 7 executes a left-hand rotation, the abrasive wheel 8 is likewise subject to a left-hand rotation through the substantially equal rotation angle. Gears which produce rotary motion in the same sense from one drive motor 16 to a rigidly arranged spindle 21 or a rigidly held drive shaft 6 and a pivotably held drive spindle or drive shaft are known to those skilled in the art. Such a gear can for example be realized with three meshing gear wheels and if necessary by the use of a cardan joint.

Figure 6:
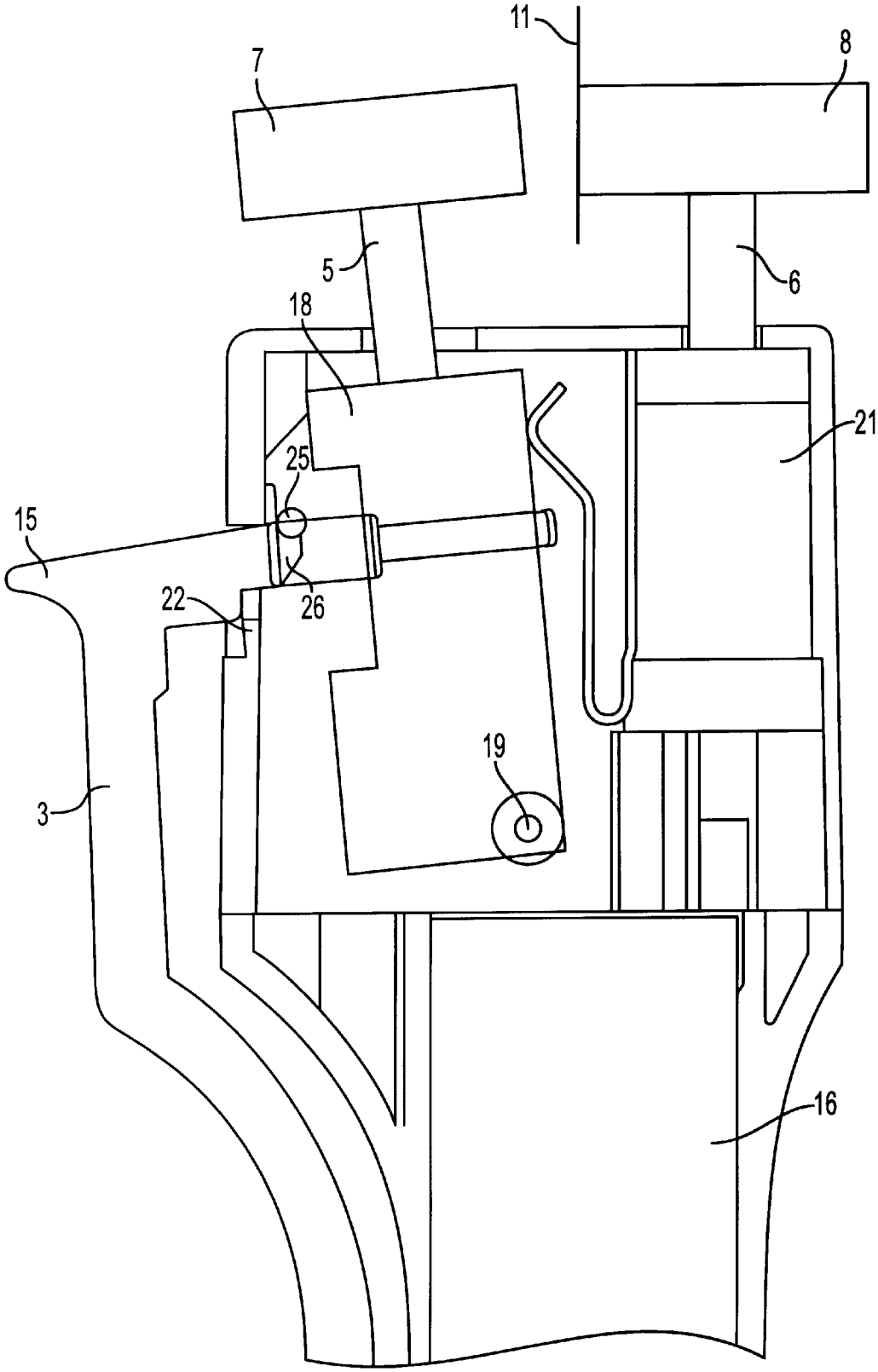
FIG. 6 shows a diagram of a cross section according to FIG. 5, in which the actuating element of the tool is no longer secured.

Reference is now made to FIG. 6, in which the actuating element 3 is shown in its position in which it is no longer secure and is pushed upward relative to the housing 2, and the stop or projection 22 of the upper portion of the housing 2 no longer prevents the actuating element from being pushed in. In this state, the tool 1 is ready to operate, i.e., can be switched on, however, a metal sheet 11 can still be inserted between the abrasive wheels 7 and 8.

Figure 7:
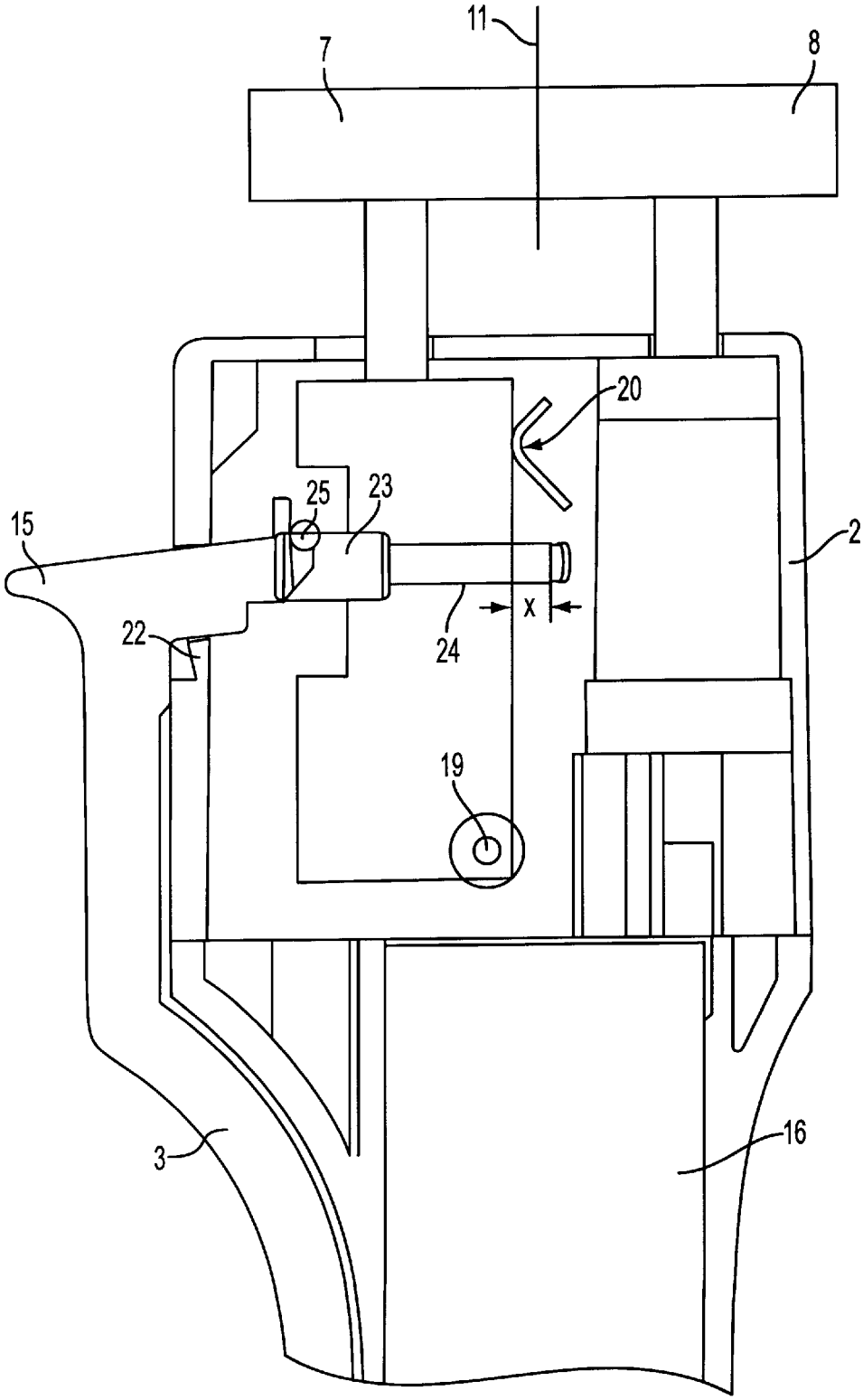
FIG. 7 shows a diagram of a cross sectional diagram of the tool according to the invention according to FIGS. 5 and 6, in which the actuating element is no longer secured and is pressed into the housing, the abrasive wheels being pivoted toward each other.

If the actuating element 3, as shown in FIG. 7, is pushed into the housing 3, a pivoting motion of the drive spindle 18 and the drive shaft 5 held therein, with the abrasive wheel 7, can thereby be effected toward the right to the workpiece 11; this is described in detail hereinbelow.

The upper end of the drive element 3 does not directly contact the drive spindle 18, since a regulating device for the pressing force of the drive spindles 18, 21, or the abrasive wheels 7, 8 driven by them, is surrounded by the tool 1 in a manner according to the invention.

This regulating device includes a cylindrical pin 23, the end of which on the left side is widened. The cylindrical pin 23 is held, displaceably and rotatably relative to the longitudinal axis of the cylindrical pin 23, in a through bore 24 through the drive spindle 18. A pressure spring (not shown in the drawing) is arranged in the through bore 24 such that a resilient force acts on the pin 23 toward the left. If the cylindrical pin 23 is pressed to the right by means of the upper end 15 of the actuating element 3, this first effects a pivoting motion of the drive spindle 18 about its pivot axis 19 toward the right, against the force of the leaf spring 20. Thus there occurs a gripping of the sheet to be processed, in the manner of tongs, by the abrasive wheels 7, 8, and a full-surface abutment of their envelope surfaces on the sheet surface. If the actuating element 3 is then pressed further into the housing 2, its upper end 15 then lies in the neighborhood of the stop 22 on the housing 2 and thereby produces a later defined displacement of the cylindrical pin 23 by the amount "x" shown in FIG. 7 in its axial direction, but however no further pivoting motion of the drive spindle 18.

The amount of the displacement "x", together with the spring constants of the pressure spring associated with the pin 23, enables a definition of the pressing forces of the abrasive wheels 7, 8 on the metal sheet 11 to be given very accurately. Because the workpiece 11 is engaged as if by tongs, the pressing force of both abrasive wheels 7, 8 is substantially identical.

In order to transmit the force of the actuating element 3 to the pin 23 with as little play as possible and with good tactile contact, and furthermore to produce a restoring force in the direction of the longitudinal axis of the actuating element 3, a pin 25 is held fast in the pin 23, perpendicular to the longitudinal axis of the pin 23. As shown in FIGS. 5, 6 and 7, the position of the pin 25 set into the pin 23 can be changed upward or downward by a rotation of the pin 23. A force on the projection 26 of the upper portion 15 can thereby be produced in the longitudinal direction of the actuating element 3. This force can be produced either by a tension spring which acts on the pin 25, or by a rotary spring which acts on the pin 23.

Reference is now made to FIG. 8, in which the first embodiment according to the invention with a pneumatic motor 16 can be recognized. The actuating element 3 acts when pressed into the housing 2 on the valve body 27 of a starting valve 17, and in this way releases the passage from the air supply channel 28 of the pneumatic motor 16 for pneumatic connection. The valve body 27, prestressed axially toward the left against a pressure spring (not shown in the drawing), thereby enters the substantially cylindrical valve chamber 30 for the starting valve 17, which has a passage opening 31 of circular shape in its cylindrical envelope surface.

The valve chamber 30 is formed by an adjustable, rotatably held cup-shaped element 32, in the right side floor of which a slot like the slot in the head of a screw is formed, by means of which the cup-shaped element 32 can be rotated around its longitudinal axis. By a rotation of the cup-shaped element 32, the passage opening 31 can be displaced relative to the feed channel 33, and its width of opening can be changed. This gives a throttle action, by means of which the power of the pneumatic drive motor 16 can be precisely set and in the most compact manner. The tool 1 according to the invention can thereby be optimized for the respective working pressures or for different abrasive wheels 7, 8.

In an alternative embodiment according to the invention, the drive motor 16 can be an electric motor which is operated by supply current or from a battery, the starting valve 17 being replaced by an electrical or electronic switch, which preferably also permits the setting of a predetermined rpm and/or a predetermined torque.

Furthermore, it is within the scope of the invention to provide the abrasive wheels 7, 8 with a bayonet, to make possible as rapid a change of grinding tools as possible, as described in German Utility Model G 94 16 005.8, which is incorporated herein by reference. Furthermore, one of the two drive shafts 5, 6 can be releasably fastened in the drive spindles 18, 21.

Due to the outstanding performance properties of the tool 1 according to the invention, its use is not, however, limited in practice to metallic sheets or objects. For example, plastic parts can also be freed from coverings or coatings with one or both of the abrasive wheels 7, 8 described hereinabove, in order to make possible a subsequent adhesion, or a chemical or thermal welding.

It is furthermore possible to use the tool according to the invention, for example in the forms driven by supply current or batteries, for preparation for the lacquering of metal grids, stair banisters, or similar columnar or prismatic workpieces.

I claim:

1. A hand-held, material-removing tool for processing sheet material, comprising:

at least a first abrasive body having on the outer surface thereof a material-remover for the processing of sheet material, a drive device for driving said first abrasive body, and a second abrasive body driven by said drive device, a device that pivots at least one of said first and second abrasive bodies towards the other of said first and second abrasive bodies to change the distance between said first and second abrasive bodies, such that double-sided simultaneous processing by both said first and second abrasive bodies of said sheet material arranged between said first and second abrasive bodies is enabled.

2. The hand-held tool according to claim 1, wherein said device that pivots said at least one of said first and second abrasive bodies comprises two drive spindles each holding one of said two drive spindles being arranged to be pivotable or displaceable toward the other.

3. The hand-held tool according to claim 2, further comprising a regulating device by which contact pressure from said drive spindles on said first and second abrasive bodies can be limited or automatically set, independently of actuating pressure of an operator.

4. The hand-held tool according to claim 1, in which said drive device includes a rotary drive and said abrasive bodies comprise rotationally symmetrical abrasive wheels.

5. The hand-held tool according to claim 4, in which at least one of said abrasive bodies automatically aligns parallel to a surface to be processed.

6. The hand-held tool according to claim 1, further comprising at least one axial stop that forms a guide device for said abrasive bodies relative to the edge of a sheet to be processed.

7. The hand-held tool according to claim 1, further comprising drive shafts removably attached to said abrasive bodies, said drive shafts and said abrasive bodies being respectively removably attached to said tool.

8. The hand-held tool according to claim 1, further comprising a housing and an actuating element arranged laterally on said housing by which the tool is operated with one hand.

9. The hand-held tool according to claim 8, in which said actuating element is secured against switching on in its switched-off position.

10. The hand-held tool according to claim 9, in which at least one of said first and second abrasive bodies is arranged to pivot toward the other abrasive body by operation of said actuating element in an unsecured position of said actuating element.

11. The hand-held tool according to claim 10, in which said drive device is switched on by operation of said actuating element before or during pivoting of at least one of said first and second abrasive bodies.

12. The hand-held tool according to claim 1, in which said drive device includes a pneumatic motor having a starting valve with an adjustable throttle.

13. The hand-held tool according to claim 1, in which said drive device includes an electric motor, the torque and/or rpm of which is electronically regulated.

14. The hand-held tool according to claim 1, further comprising a housing and a covering that is reversibly set on said housing and provides a plurality of covering regions.

15. The hand-held tool according to claim 1, further comprising a suction device for grinding material, which suction device is arranged on said covering or said housing.

* * * * *